US008710752B2

(12) United States Patent
Jin et al.

(10) Patent No.: US 8,710,752 B2
(45) Date of Patent: Apr. 29, 2014

(54) ADAPTIVE SWITCH MODE LED SYSTEM

(75) Inventors: Xuecheng Jin, Palo Alto, CA (US); Minjong Kim, San Jose, CA (US); Enzhu Liang, Pacifica, CA (US); John William Kesterson, San Jose, CA (US); Xiaoyan Wang, Milpitas, CA (US)

(73) Assignee: Dialog Semiconductor Inc., Campbell, CA (US)

( * ) Notice: Subject to any disclaimer, the term of this patent is extended or adjusted under 35 U.S.C. 154(b) by 244 days.

(21) Appl. No.: 13/040,229

(22) Filed: Mar. 3, 2011

(65) Prior Publication Data

US 2012/0223648 A1 Sep. 6, 2012

(51) Int. Cl.
*H05B 37/00* (2006.01)

(52) U.S. Cl.
USPC ..... 315/186; 315/307; 315/360

(58) Field of Classification Search
USPC ..... 315/185 R, 186, 192, 247, 291, 294, 315/297, 307–308, 312, 360
See application file for complete search history.

(56) References Cited

U.S. PATENT DOCUMENTS

| | | | |
|---|---|---|---|
| 6,538,394 | B2 | 3/2003 | Hurtz et al. |
| 6,577,512 | B2 | 6/2003 | Tripathi et al. |
| 6,586,890 | B2 | 7/2003 | Min et al. |
| 6,618,031 | B1 | 9/2003 | Bohn, Jr. et al. |
| 6,864,641 | B2 | 3/2005 | Dygert |
| 7,071,630 | B1 | 7/2006 | York |
| 7,122,971 | B2 | 10/2006 | Yeh et al. |
| 7,148,632 | B2 | 12/2006 | Berman et al. |
| 7,256,554 | B2 | 8/2007 | Lys |
| 7,262,559 | B2 | 8/2007 | Tripathi et al. |
| 7,358,679 | B2 | 4/2008 | Lys et al. |
| 7,737,643 | B2 | 6/2010 | Lys |
| 7,777,704 | B2 | 8/2010 | S et al. |
| 7,928,670 | B2 | 4/2011 | Chen et al. |
| 8,040,079 | B2 * | 10/2011 | Zhao ..... 315/299 |
| 8,247,992 | B2 * | 8/2012 | Liu et al. ..... 315/291 |
| 8,279,144 | B2 * | 10/2012 | Zhao et al. ..... 345/82 |
| 2008/0116818 | A1 | 5/2008 | Shteynberg et al. |

(Continued)

FOREIGN PATENT DOCUMENTS

| | | | |
|---|---|---|---|
| JP | 2007-066897 | A | 3/2007 |
| JP | 2009-070878 | A | 4/2009 |

(Continued)

OTHER PUBLICATIONS

Korean Intellectual Property Office, Office Action, Korean Patent Application No. 10-2012-0021993, Jul. 11, 2013, five pages.

(Continued)

*Primary Examiner* — Tung X Le
(74) *Attorney, Agent, or Firm* — Fenwick & West LLP

(57) ABSTRACT

A system that provides an intelligent approach to driving multiple strings of LEDs. A processing device determines an optimal current level for each LED string from a limited set of allowed currents. The processing device also determines a PWM duty cycle for driving the LEDs in each LED string to provide precise brightness control over the LED string. The settings for the current level and duty cycle are transmitted to an LED driver for regulating the current and on-off times of the LED strings. Beneficially, the system reduces the size of the LED driver while leveraging existing resources available in the processing device to operate the LEDs in a power efficient manner.

23 Claims, 8 Drawing Sheets

(56) References Cited

U.S. PATENT DOCUMENTS

| | | | | |
|---|---|---|---|---|
| 2008/0224025 | A1* | 9/2008 | Lyons et al. | 250/205 |
| 2009/0021384 | A1 | 1/2009 | Jacubovski et al. | |
| 2009/0079355 | A1* | 3/2009 | Zhou et al. | 315/246 |
| 2009/0189548 | A1* | 7/2009 | Hoffman et al. | 315/307 |
| 2010/0244726 | A1* | 9/2010 | Melanson | 315/291 |
| 2011/0062872 | A1 | 3/2011 | Jin et al. | |
| 2011/0279048 | A1* | 11/2011 | Briggs | 315/210 |

FOREIGN PATENT DOCUMENTS

| | | | |
|---|---|---|---|
| JP | 2009-157385 | A | 7/2009 |
| KR | 10-2004-0037301 | A | 5/2004 |
| KR | 10-0628717 | B1 | 9/2006 |
| KR | 10-0665369 | B1 | 12/2006 |
| KR | 10-2009-0056566 | A | 6/2009 |
| TW | 2009-08809 | A | 2/2009 |

OTHER PUBLICATIONS

Japanese Patent Office, Office Action, Japanese Patent Application No. 2012-046551, Sep. 17, 2013, six pages.

Korean Intellectual Property Office, Office Action, Korean Patent Application No. 10-2010-0030285, Apr. 22, 2011, six pages.

Linear Technology Corporation, "Triple Output LED Driver" LT3496 Datasheet, 2007, sixteen pages.

Maxim Integrated Products, "Six-String White LED Driver with Active Current Balancing for LCD Panel Applications," MAX8790 Datasheet, Nov. 2006, 24 pages.

Reatti, A., et al., Small-Signal Model of PWM Converters for Discontinuous Conduction Mode and Its Application for Boost Converter, *IEEE Transactions on Circuits and Systems*—I: *Fundamental Theory and Applications*, Jan. 2003, pp. 65-73, vol. 50, No. 1.

Scharf, G., "Behaviour of InGaN LEDs in Parallel Circuits: Application Note," *OSRAM*, May 17, 2002, four pages.

State Intellectual Property Office of the People's Republic of China, First Office Action, Chinese Patent Application No. 201010160505.6, Mar. 1, 2013, ten pages.

Taiwan Intellectual Property Office, Office Action, ROC (Taiwan) Patent Application No. 099109452, Feb. 22, 2013, eight pages.

Vopérian, V., "Simplified Analysis of PWM Converters Using Model of PWM Switch Part I: Continuous Conduction Mode," *IEEE Transactions on Aerospace and Electronic Systems*, May 1990, pp. 490-496, vol. 26, No. 3.

Vopérian, V., "Simplified Analysis of PWM Converters Using Model of PWM Switch Part II: Discontinuous.Conduction Mode," *IEEE Transactions on Aerospace and Electronic Systems*, May 1990, pp. 497-505, vol. 26, No. 3.

Korean Intellectual Property Office, Office Action, Korean Patent Application No. 10-2012-0021993, Jan. 23, 2014, seven pages.

* cited by examiner

ADAPTIVE SWITCH MODE LED SYSTEM

BACKGROUND OF THE INVENTION

1. Field of the Invention

The present invention relates to driving LEDs (light-emitting diodes) and, more specifically, to a system for driving multiple strings of LEDs.

2. Description of the Related Arts

LEDs are being adopted in a wide variety of electronics applications, for example, architectural lighting, automotive head and tail lights, backlights for liquid crystal display devices including personal computer, laptops, high definition TVs, flashlights, etc. Compared to conventional lighting sources such as incandescent lamps and fluorescent lamps, LEDs have significant advantages, including high efficiency, good directionality, color stability, high reliability, long life time, small size, and environmental safety.

LEDs are current-driven devices, meaning that the luminous flux (i.e. brightness) generated from them is primarily a function of the current applied through them. Thus regulating the current through the LEDs is an important control technique. To drive a large array of LEDs from a direct current (DC) voltage source, DC-DC switching power converters such as a boost or buck-boost power converters are often used to supply the top rail voltage for several strings of LEDs. In Liquid Crystal Display (LCD) applications using LED backlights, it is often necessary for a controller to control several strings of LEDs in parallel with independent current settings for each string. The controller can then independently control the brightness of different sections of the LCD. Furthermore, the controller can turn different parts of the LCD on or off in a timed manner.

Due to manufacturing differences between the LEDs, the voltage drop across each LED string necessary to maintain a specified current level varies considerably. The VI curve of FIG. 1 illustrates the exponential relationships between voltage and current for two different LEDs (LED1 and LED2). For LED1 and LED2 to provide the same amount of peak current, LED1 must operate at a forward voltage drop of about 3.06 volts, while LED2 must operate at a forward voltage drop of about 3.26 volts. Assuming there are 10 LEDs having the characteristics of LED1 in a first LED string, there is a 30.6 V drop across the string. Assuming there are 10 LEDs having the characteristics of LED2 in a second LED string 102, there is a 32.6 V drop across the second LED string. This difference of 2 volts will therefore be dissipated by circuitry driving the second string such that both strings operate at the same peak current of 40 mA.

The unpredictable VI characteristics of different LEDs makes it difficult to operate different LED strings in a power efficient manner while still maintaining precise control over the brightness of the LED strings. Different techniques have been developed to address this challenge, but many conventional solutions are either inefficient or require the use of additional circuitry that substantially increases the cost of the components used to regulate current through the LED strings.

SUMMARY OF THE INVENTION

Embodiments of the present invention include a system, LED driver, and method for controlling current through one or more LED strings. The system includes a LED driver device and a processing device. The processing device is an integrated circuit device that is distinct (i.e. separate) from the LED driver. The LED driver device regulates current through one or more LED strings according to programmed current levels and switches the LED strings on and off at duty cycles indicated by duty cycle settings (e.g., duty cycle expressed as a ratio or Ton and Tperiod times) received from the processing device. The processing device (e.g., a CPU or FPGA) determines the duty cycles for the LED strings as a function of the programmed current levels, baseline current level, and a baseline duty cycle and transmits settings for the duty cycles to the LED driver. In one embodiment, the processing device determines the duty cycles for the LED strings by determining a ratio of the programmed current level to a baseline current level and multiplying the ratio by a baseline duty cycle.

In one embodiment, the processing device and the integrated circuit device communicate with each other via a communication link. The communication link carries information between the two devices, such as duty cycle settings, programmed current levels, regulation information indicating whether current through the LED strings is out of regulation, and/or fault detection information indicating whether the LED strings are open or short. In one embodiment, the processing device is also configured to determine the programmed current level to correspond to one of a limited set of programmable current levels.

Beneficially, through the use of a separate processing device, the system provides a cost effective solution for maintaining precise control over the relative brightness of different LED channels while still allowing for current variations between LED channels. By performing duty cycle calculations in a processing device that is distinct from the LED driver itself, the complex circuitry needed to perform these calculations can be removed from the LED driver. Because many systems that use LEDs (e.g., television, monitors) already have processing devices capable of performing mathematical calculations, no extra hardware is needed. Further, because processing devices may be programmable, the formulas for calculating the duty cycle and current settings for the LED channels can be easily updated without any hardware changes.

Embodiments of the LED driver include one or more channel regulators (e.g., a low dropout regulator) coupled in series with the corresponding LED strings that regulate current through the LED strings according to the programmed current levels. The LED driver also includes channel switches (e.g., a PWM switch) coupled in series with the corresponding LED strings and channel regulators that switch the LED strings on and off at the calculated duty cycles. The settings for the duty cycles are received from the processing device.

Embodiments of the present invention also include a method for driving one or more LED strings. In one embodiment, current is regulated through the LED strings according to programmed current levels. Duty cycles settings are received for switching the LED strings. The duty cycle settings are received from a processing device that is distinct from the LED driver and that determines the duty cycles as a function of the programmed current levels. The LED strings are then switched on and off at duty cycles indicated by the duty cycle settings.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The teachings of the embodiments of the present invention can be readily understood by considering the following detailed description in conjunction with the accompanying drawings.

DETAILED DESCRIPTION OF EMBODIMENTS

The figures and the following description relate to preferred embodiments of the present invention by way of illustration only. It should be noted that from the following discussion, alternative embodiments of the structures and methods disclosed herein will be readily recognized as viable alternatives that may be employed without departing from the principles of the claimed invention.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the invention described herein.

System Architecture

Figure 1:
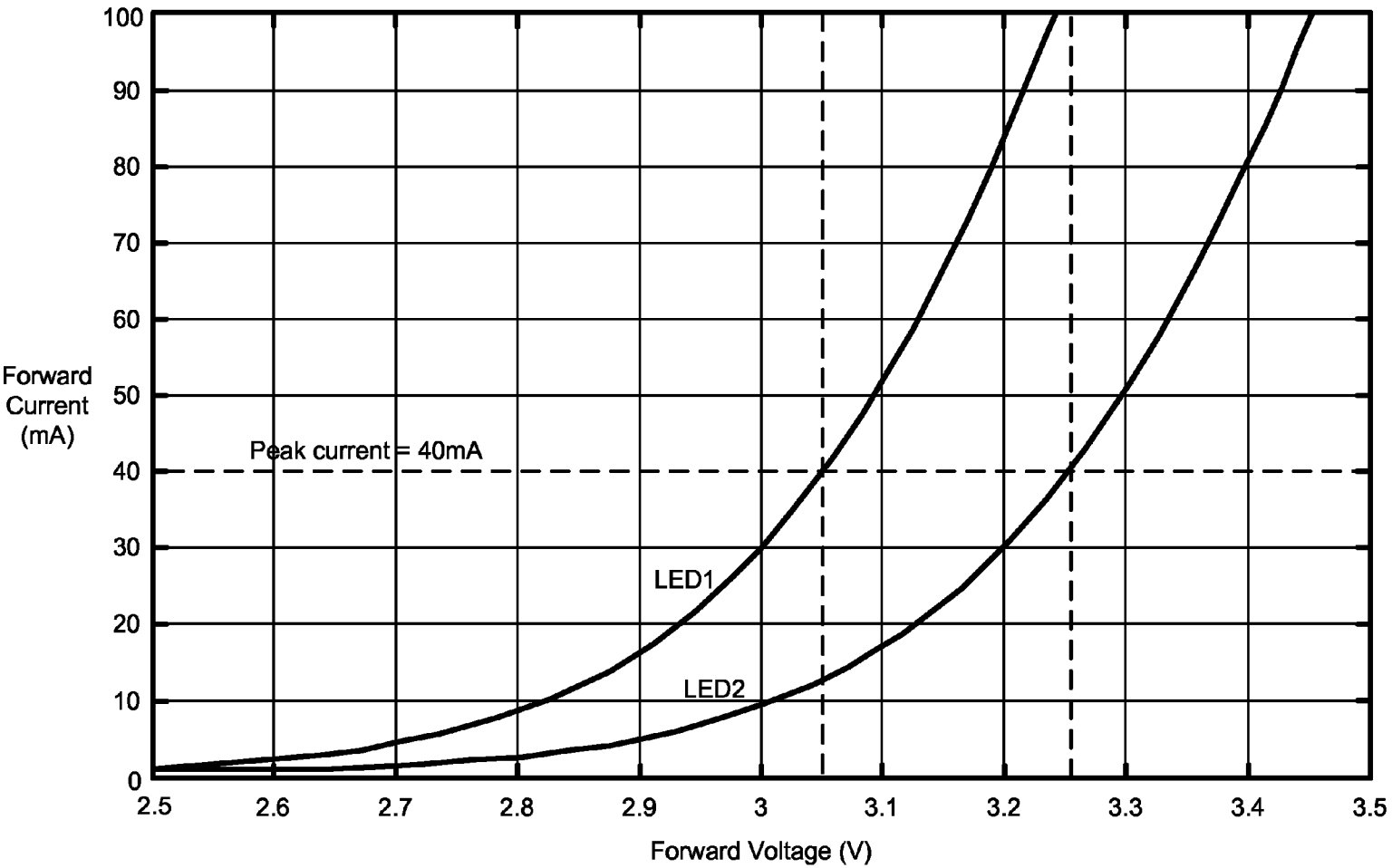
FIG. 1 is a plot illustrating the effects of the manufacturing differences on the I-V curves of forward biased LEDs.
Figure 2:
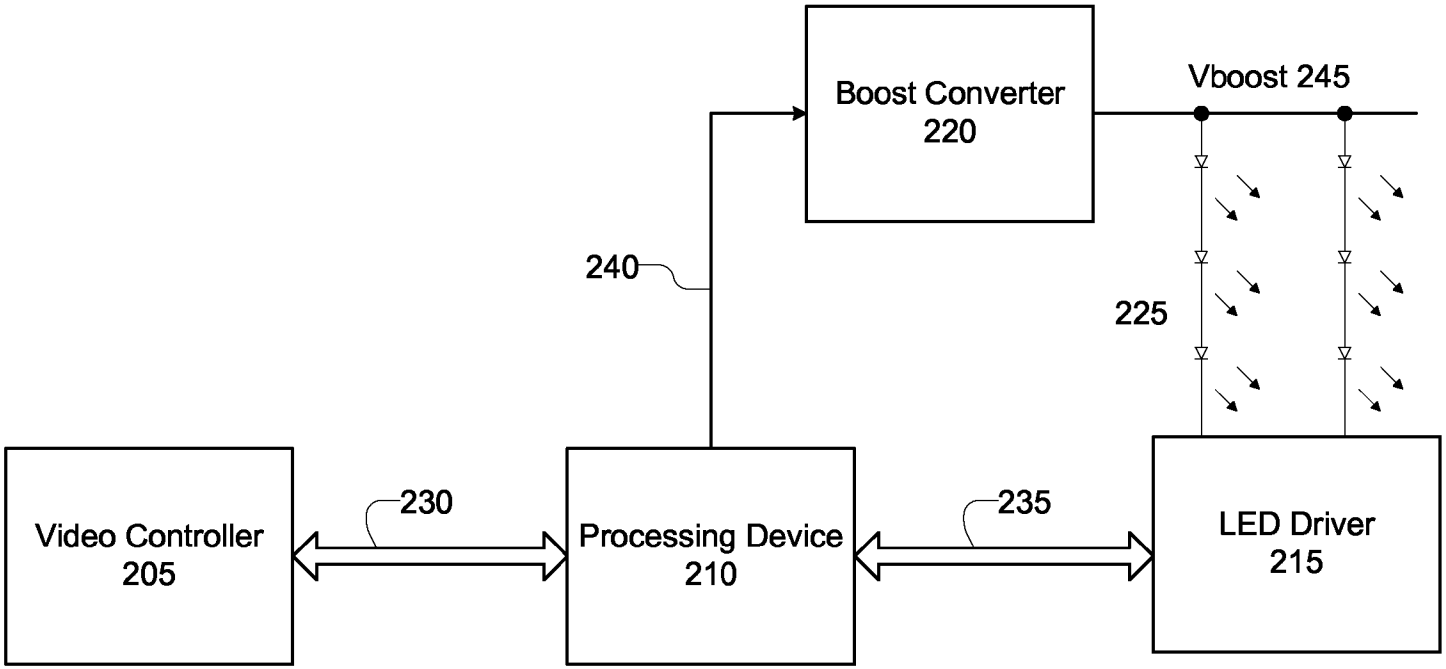
FIG. 2 illustrates a high level overview of a system for driving multiple strings of LEDs.

FIG. 2 illustrates one embodiment of a high level overview of a system for driving multiple strings of LEDs 225. The system uses adaptive switching as a technique to efficiently drive multiple strings of LEDs 225. In adaptive switching, each LED string may be operated at a different peak current value and the on/off times of the current through each LED string are adjusted to vary the brightness of the LED strings 225. To maintain a consistent brightness across the LED strings 225, LED strings 225 with higher peak current values will have lower duty cycles, and LED strings 225 with lower current values will have higher duty cycles.

As shown, boost converter 220 provides a common voltage Vboost 245 to multiple LED strings 225 and is controlled by the processing device 210 via control signal 240. LED driver 215 is an integrated circuit device that controls the brightness of the LED strings 225 by regulating the peak current and duty cycles (i.e. on/off times) of the current flowing through the LED strings using settings received from the processing device 210 via communications link 235.

Processing device 210 determines the current levels and duty cycles (i.e. on/off times) of the LED strings 225. Processing device 210 represents any integrated circuit device capable of performing mathematical calculations, such as a microprocessor, television image processor, field programmable gate array (FPGA), programmable logic device (PLD) or microcontroller. Processing device 210 and LED driver 215 are distinct (i.e. separate and different) integrated circuit devices. In other words, processing device 210 is not a part of the same integrated circuit device as LED driver 215.

Processing device 210 and LED driver 215 communicate with each other through a communication link 235. Communications link 235 may represent any serial or parallel link connecting two or more integrated circuit devices to carry information. For example, communication link 235 may be a serial protocol interface (SPI), an inter-integrated circuit bus (I2C), etc. Communications link 235 may also represent an aggregation of individual communication links where each link is dedicated to carrying one type of information (e.g., duty cycle settings, programmed current level, or regulation information).

In one embodiment, the processing device 210 receives regulation information from the LED driver 215 via the communication link 235 indicating whether the current flowing through a LED channel 225 is in or out of regulation. During a calibration process, the processing device 210 uses the regulation information to determine a programmed current value for each of the LED channels 225 from a limited set of current values. Each LED channel may have a different programmed current value depending on the forward voltage drop across the LED channel.

The processing device 210 receives brightness settings and predetermined baseline current settings for the LED strings 225 from the video controller 205 via communications link 230. Communications link 230 represents any type of link connecting two or more integrated circuit devices that is capable of carrying information. In one embodiment, video controller 205 determines brightness settings and predetermined baseline current settings. For example, video controller 205 may be a device that controls an LCD display to form an image. The video controller 205 determines the required backlighting requirements for the LCD display, which it transmits to the processing device 210 as brightness and baseline current information. Although shown as two separate devices, in one embodiment, video controller 205 and processing device 210 may be separate components of the same integrated circuit device or separate threads in the firmware executing on the same integrated circuit device.

Separate brightness settings can be provided for each string of LEDs so that the brightness of the LED channels 225 can be independently controlled. Using the predetermined baseline current setting, brightness settings, and the programmed current levels, the processing device 210 calculates duty cycles for the LED channels 225. The duty cycles compensate for the variations between the programmed current values of each LED channel to maintain control over the relative brightness of each LED channel 225. Duty cycle settings and programmed current level are provided to the LED driver 215 for driving an LED string 225. Beneficially, by calibrating the programmed current levels and determining the duty cycle settings in a processing device 210 instead of the LED driver 215, the disclosed embodiments leverage readily available resources in the processing device 210 while reducing the size, cost, and power consumption of the LED driver 215.

Detailed System Architecture

Figure 3:
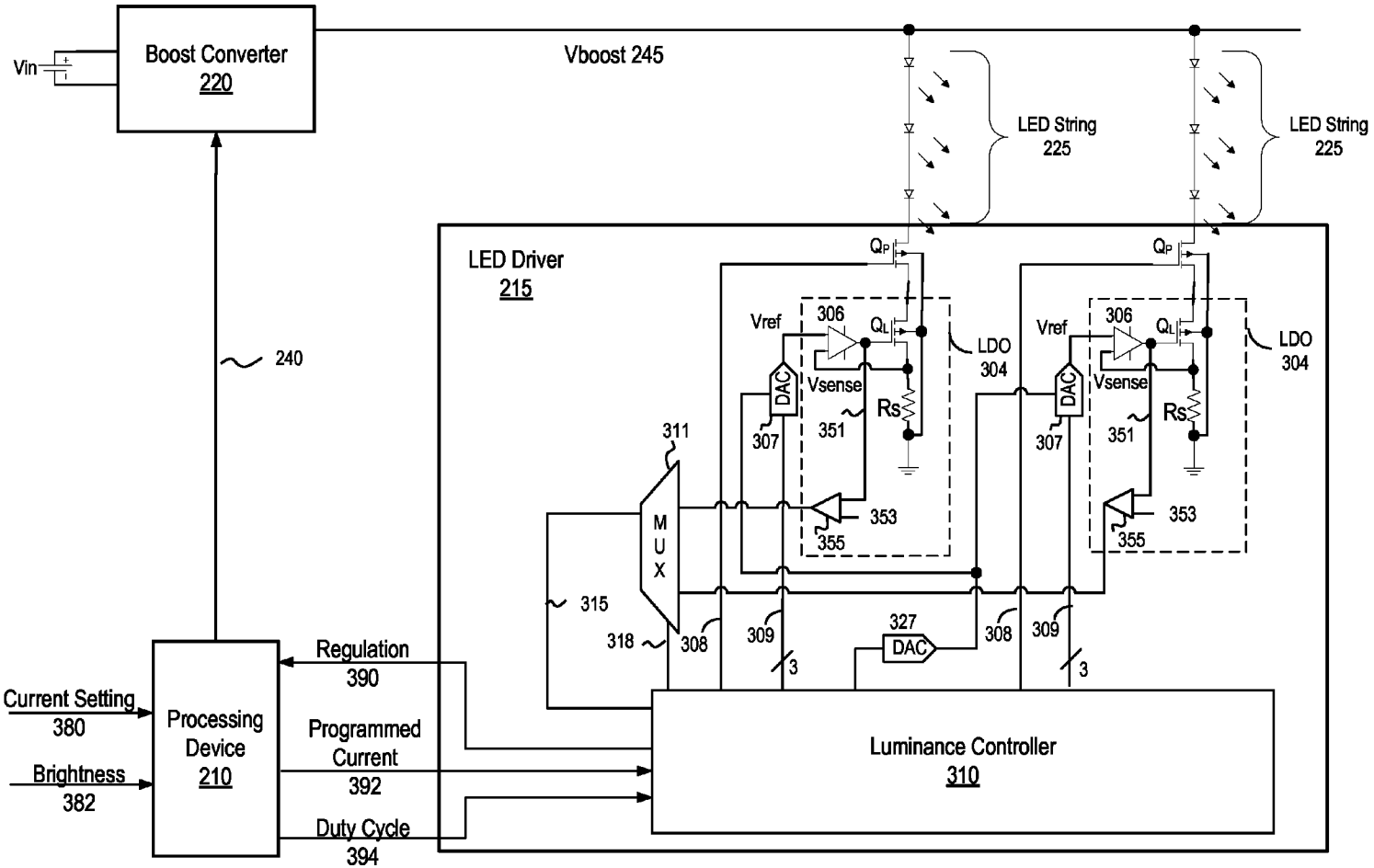
FIG. 3 is a circuit diagram illustrating an embodiment of a LED driver controlled by a processing device.

FIG. 3 is a circuit diagram of an embodiment of an LED driver 215 controlled by a processing device 210. Processing device 210 outputs a control signal 240 for controlling the Vboost 245 voltage output of DC-DC boost converter 220. In other embodiments, boost converter 220 may be replaced with other types of DC-DC or AC-DC power converters.

Boost converter 220 is coupled between DC input voltage Vin and multiple strings of LEDs 225 (i.e., LED channels). The output Vboost 245 of boost converter 220 is coupled to the anode of the first LED in each LED channel 225.

In each LED channel, LED string 225 is coupled in series with PWM switch $Q_P$ (e.g., an NMOS transistor) for controlling the on-times and off-times of the LEDs in LED channel 225. LED string 225 and PWM Switch $Q_P$ are also coupled in series with low dropout regulator (LDO) 304 for regulating current through LED channel 125. LDO 304 ensures that the peak current in LED string 225 is regulated to a fixed level. LDOs 304 also provide a native power supply rejection that reduces the impact of the boost voltage ripple from Vboost on the luminance of LED strings 225. In each LED channel, LDO 304 dissipates power proportional to the product of the current through LED channel 225, the PWM duty cycle, and the voltage drop across LDO 304.

The LED driver 215 includes a luminance controller 310 that controls the brightness of each LED channel independently by controlling PWM switches $Q_P$ via control signals 308 in accordance with duty cycle settings 394 received from the processing device 210. Duty cycle settings 394 include information that can be used to set the on and off times of the PWM switches $Q_P$, for example, a percentage of time (e.g., 40%, 60%), or a separate duty cycle on time and duty cycle period. Luminance controller 310 also controls the LDOs 304 via control signals 309 and digital-to-analog converters (DACs) 307 in accordance with programmed current levels 392 received from processing device 210.

Additionally, LDO 304 outputs a regulation feedback signal 315 indicating whether the LDO 304 is out of regulation to luminance controller 310 via multiplexer 311. This regulation feedback is transmitted to the processing device 210, which uses this regulation information 390 to set the programmed current levels 392 through the LED channels 225 during calibration, which is described in greater detail below.

Although FIG. 3 illustrates only two LED channels, LED driver 215 can include circuitry for controlling any number of LED strings 225. Other embodiments of LED driver 215 are shown in U.S. Patent Application Publication No. 2009/0322234 titled "LED Driver with Multiple Feedback Loops" and U.S. application Ser. No. 12/558,275 filed on Sep. 11, 2009 titled "Adaptive Switch Mode LED Driver," the contents of which are incorporated by reference herein in their entirety.

The processing device 210 receives a baseline current setting 380 and brightness setting 382. Referring back to FIG. 2, the baseline current setting 380 and brightness setting 382 are received from the video controller 205 via communication channel 230. In another embodiment, the current setting 380 may be received from another source, such as an external resistor that sets the current values. The processing device 210 calculates programmed current levels 392 and duty cycle settings 394 for each LED channel and transmits these settings to the luminance controller 310 of the LED driver 215. Referring back to FIG. 2, in one embodiment, the regulation information 390, programmed current levels 392, and duty cycle settings 394 are communicated between the processing device 210 and LED driver 215 via communication link 235.

In other embodiments, the processing device 210 may also receive other types of information from the video controller 205, which are then passed on to the luminance controller 310. For example, the processing device 210 may receive delay information for each LED channel, which is then communicated to the luminance controller 310. The delay information is used by the luminance controller 310 to delay the on time of PWM switch $Q_P$ during each PWM cycle so that the on times of some LED channels are staggered relative to other LED channels.

Low Dropout Regulator (LDO)

LDO 304 regulates current through the LED strings 225 according to programmed current levels for each LED channel. Each LDO 304 comprises operational amplifier (op-amp) 306, sense resistor $R_S$, and pass transistor $Q_L$ (e.g., an NMOS transistor). Pass transistor $Q_L$ and sense resistor $R_S$ are coupled in series between PWM switch $Q_P$ and a ground terminal. The output of op-amp 306 is coupled to the gate of pass transistor $Q_L$ to control current through the LDO 304. Op-amp 306 receives positive input signal Vref from DAC 307 and receives negative input signal Vsense via a negative feedback loop from the source of pass transistor $Q_L$.

LDO 304 comprises a feedback loop that senses the current through the LED string via Vsense and controls the pass transistor $Q_L$ to maintain the sensed current at the programmed current level set by Vref. Op-amp 306 compares Vref to Vsense. If Vref is higher than Vsense, op-amp 306 increases the gate voltage applied to pass transistor $Q_L$, increasing current flow through sense resistor $R_S$ and LED string 225 until it stabilizes at Vref. If Vsense becomes higher than Vref, then op-amp 306 decreases the gate voltage applied to pass transistor $Q_L$, decreasing current flow through $R_S$ and causing Vsense to drop until it stabilizes at Vref. Thus, LDO 304 uses a feedback loop to maintain Vsense at Vref, thereby maintaining the current through the LED string 225 to a fixed value proportional to Vref. In one embodiment, a sample and hold circuit (not shown) maintains the Vsense voltage level even when the PWM switch $Q_P$ is off.

LDO 304 additionally includes a comparator 355 that compares the output 351 of op-amp 306 to a reference voltage 353 and outputs the resulting signal to the multiplexer 311. The output of the comparator 355 indicates whether the current through the LDO is out of regulation. For example, if the DAC setting is too high for the LDO to maintain the current at the programmed level due to insufficient Vboost 245 voltage at the top of the LED string 225, the output of the op-amp 306 will ramp up to a level above the reference voltage 353. In other alternative embodiments, input 351 to comparator 355 can be coupled to the drain or source of LDO transistor $Q_L$ instead of to the output of op-amp 306.

Luminance Controller and Processing Device

Luminance controller 310 and processing device 210 work together to monitor characteristics of each LED channel and to set the peak currents and PWM duty cycles to maintain brightness matching between LED channels and optimize power efficiency. For each LED channel, luminance controller 310 receives programmed current levels 392 and duty cycle settings 394 from the processing device 210. Luminance controller 310 then outputs control signals 308, 309, 318 to control LDOs 304, PWM switches $Q_P$, and multiplexer 311, respectively. Luminance controller 310 also receives the regulation feedback signal 315 from LDOs 304 and transmits the regulation feedback 390 to the processing device 210.

Control signals 309 digitally set the outputs of DACs 307, which in turn provides the analog reference voltage Vref that sets the programmed current through LED strings 225. In one embodiment, control signal 309 is a 3 bit DAC word that allows for 8 possible programmable currents. For example, in one embodiment each LED channel can be set for a current in the range 40 mA to 54 mA in 2 mA increments. The programmed current level is determined by the processing device 210 for each LED channel 225 during a calibration stage as will be described below. Luminance controller 310 controls each LED channel independently such that different LED channels can be configured for different programmed currents by the processing device 210.

In one embodiment, the resolution of the DAC 307 is only 3 or 4 bits. To allow for a large dynamic range of current operation, another DAC 327 produces the seed reference for each DAC 307. The DAC 327 is used to set the base level that will be used when the DAC 307 is digitally set to zero by control signal 309. DAC 327 may have, for example, a 10 bit resolution for better control of the range of currents in the LED channels.

Control signals 308 digitally control PWM switches $Q_P$ for each LED channel according to duty cycle settings 394 for the LED channel. The processing device 210 determines the duty cycle settings 394 for each LED channel as a function of the programmed current 392, baseline current setting 380, and brightness setting 382 during a calculation process as will be described below in greater detail. Luminance controller 310 controls the duty cycle of each LED channel 225 independently such that different LED channels 225 can be configured for different PWM duty cycles by the processing device 210. The duty cycle settings 394 and programmed current 392 for a given LED channel collectively determine the brightness of the LEDs in the LED channel.

Control signal 318 controls switching of multiplexer 311. Luminance controller 310 sequentially monitors feedback signals from the different LED channels by switching the select line 318 of the multiplexer 311. Alternatively, luminance controller 310 can monitor the feedback signals from the different LED channels without the use of a multiplexer 311. The luminance controller 310 passes the regulation feedback 390 to the processing device 210 for use in the calibration stage described in more detail below.

Processing device 210 receives a brightness input 382 that specifies a relative brightness $BI_n$ for each LED channel n. In one embodiment, the brightness input $BI_n$ expresses the desired relative brightness for each LED channel n as percentage of a predefined maximum brightness (e.g., $BI_1$=60%, $BI_2$=80%, $BI_3$=100%, etc). The processor uses the brightness input $BI_n$ as a baseline duty cycle for the channel because the brightness output of a channel is directly proportional to the duty cycle. Thus, for example, a brightness input $BI_n$ of 60% indicates a baseline duty cycle for the channel n of 60% of the maximum duty cycle (corresponding to the maximum brightness). However, the processing device 210 modifies this baseline duty cycle by a compensation factor when determining the duty cycle of PWM switch $Q_P$ to compensate for the known current variations between LED channels and maintain the desired relative brightness. This compensation factor and the resulting duty cycle are determined during the calibration and calculation process described below.

Calibration Stage

The processing device 210 enters a calibration stage at the beginning of operation (e.g., shortly after startup) to determine the programmed current levels for each LED channel. Each LED channel is set independently to compensate for manufacturing variations between the LED channels 225 and maintain the relative brightness outputs between LED channels set by the brightness input 382. Thus, the processing device 210 ensures that channels configured with the same brightness inputs 382 have substantially matching brightness outputs.

Initially, the processing device 210 receives a baseline current setting 380, or Iset level (e.g., Iset=40 mA). The processing device 210 then outputs a current level 292 that causes the luminance controller 310 to initialize the DACs 307 to their lowest level. DAC 327 is also initialized to a value corresponding to the baseline current setting. Vboost 245 is then incrementally decreased (via control signal 240) until the one of the LED channels 225 fails to operate at or above the desired Iset (e.g., Iset=40 mA) level. Vboost 245 is then incremented again until all channels again operate in regulation at the desired Iset level. The weakest channel (i.e. the LED channel with the greatest forward voltage drop across the LED string 225) will operate at or near Iset, while other channels may operate at higher current levels due to the different I-V characteristics of the LED strings 302. To monitor the current levels for each LED string 225, the voltage across Rs can be sensed and passed to the processing device 210 (not shown). This information is also available in the form of DAC values from the DAC 307.

Once Vboost 245 reaches the proper level, processing device 210 sequences DACs 307 for each LED channel from their lowest level to their highest level and monitors the outputs from comparators 355, which indicate the status of regulation. When the DAC 307 output become too high for LDO 304 to maintain the current at the programmed level, the output of op-amp 306 ramps up and exceeds a threshold voltage 353 causing the comparator 355 output to change, which indicates that the channel is no longer in regulation. After a channel is out of regulation, processing device 210 sequentially decrements the DAC 307 for the LED channel until the channel is back in regulation. Processing device 210 then stores the highest possible DAC setting for the LED channel before the threshold voltage 353 is exceeded as the programmed current level $I_n$ for the LED channel n. This calibration process repeats to determine a programmed current level $I_n$ for each of the LED channels n. During normal operation following calibration, each LED channel n is set to the determined programmed current $I_n$.

The calibration process generally ensures that each LDO 304 is operating below but near the saturation point of each LDO 304 for best power efficiency. In the worst case instances when the saturation current is higher than the maximum DAC setting, the LDO 304 will operate in saturation as near as possible to the interface point between the triode and saturation region of the LDO 304.

In one embodiment, calibration is performed on-the-fly, as opposed to during an initial calibration stage. During on-the-fly calibration, the VBoost 245 voltage is set to a pre-defined voltage level and the DACs 307 are set to their lowest level. As the system is running, the Vboost 245 is decreased at certain time intervals (e.g., every 8 ms) until one or more LED strings 225 fail to operate at or above Iset, and Vboost is again increased to bring the weakest channel back into regulation. Once Vboost 245 reaches the proper level, processing device 210 sequences DACs 307 for each LED channel in parallel from their lowest level to their highest level and monitors the outputs from comparators 355. The sequencing occurs at certain time intervals (e.g, every 8 ms). When an LED string goes out of regulation, processing device 210 then stores the highest possible DAC setting for the LED channel before going out of regulation as the programmed current level $I_n$ for the LED channel n. The remaining LED strings continue to be sequenced in the same manner to identify their programmed current levels $I_n$.

Further, the regulation status of the LED channels 225 are constantly monitored by the processing device 210 as the system is running If an LED channel falls out of regulation, as indicated by the output of comparator 355 and communicated to the processing device 210 via regulation signal 390, the processing device 210 decreases the programmed current level for that LED channel until it falls back into regulation. Additionally, the processing device 210 can periodically increment the programmed current levels 392 to determine if they should be increased. If the LED channel 225 stays in regulation at the higher current level, the new DAC setting for the LED channel 225 is stored by the processing device 210 as the new programmed current level $I_n$ for the LED channel n.

In other embodiments, all or part of the calibration may be performed by the luminance controller 310 with reduced interaction by the processing device 210. In one embodiment, the boost converter 220 is directly controlled (not shown) by the luminance controller 310. Luminance controller 310 receives Iset from the processing device 210 or video controller 205. Luminance controller 310 sets VBoost 245 so that the weakest channel is operating at or near Iset. Luminance controller 310 then sequences the DACs 307 until the optimal DAC 307 settings are identified. However, performing calibration in the luminance controller 310 is not as advantageous as performing calibration in the processing device 210 because it requires additional control circuitry to be added to the luminance controller 310.

Duty Cycle Calculations

Based on the programmed current level $I_n$ determined for each LED channel n, the processing device 210 determines a PWM duty cycle ($PWM_out_n$) for each LED channel n using the following equation:

$$PWM_out_n = BI_n \frac{Iset}{I_n} \tag{1}$$

where $BI_n$ is the baseline duty cycle representing the desired relative brightness setting for the channel n and Iset is the predefined baseline current level. Equation (1) scales this baseline duty cycle by the compensation factor $$\frac{Iset}{I_n}$$

to compensate for the current variations between channels and maintain the desired relative brightness. During normal operation, processing device 210 provides $PWM_out_n$ as the duty cycle settings 394 for the channel n to the luminance controller 310. Luminance controller 310 then drives the PWM switch $Q_P$ via control signal 308 according to the duty cycle settings 394 for each channel n.

An example is now provided to further illustrate operation of the processing device 210 and luminance controller 310. In this example, the PWM brightness input 382 sets the relative brightness $BI_n$ of each channel n to 60% brightness. The current setting input 380 sets the baseline current setting Iset to 40 mA. During the calibration stage described above, the processing device 210 determines programmed current levels 392 for each LED channel and communicates the programmed current levels 392 to the luminance controller 310. Luminance controller 310 then sets the programmed current levels via control signal 309 and DACs 307. In this example, the processing device 210 sets a first LED channel to a current level of $I_1$=46 mA, a second LED channel to a current level of $I_2$=40 mA and a third LED channel to a current level of $I_3$=42 mA such that each LED channel operates near but below their saturation points. The processing device 210 applies equation (1) to the programmed current levels to determine the duty cycles $PWM_out_n$ for each LED channel n as follows:

$$PWM_out_1 = BI_1 \frac{Iset}{I_1} = 60\% \frac{40\text{ mA}}{46\text{ mA}} = 52.2\% \tag{2}$$

$$PWM_out_2 = BI_2 \frac{Iset}{I_2} = 60\% \frac{40\text{ mA}}{40\text{ mA}} = 60\% \tag{3}$$

$$PWM_out_3 = BI_3 \frac{Iset}{I_3} = 60\% \frac{40\text{ mA}}{42\text{ mA}} = 57.1\% \tag{4}$$

Thus, the calibration and calculation processes determine currents $I_n$ and duty cycles $PWM_out_n$ for each LED channel n. Beneficially, each LED channel will have the same average current ($PWM_out_n \times I_n$=24 mA). Therefore, the observed brightness of each LED channel will be well matched because brightness output is closely related to the average current through the LED channel.

If the relative brightness inputs $BI_n$ 382 are set differently for different channels n, then equation (1) ensures that the ratio between the average currents of different channels matches the ratio between the brightness inputs. For example, if a fourth channel is configured for a brightness input $BI_4$=75% and a fifth channel is configured for a brightness input $BI_5$=25%, then the processing device 210 calibrates the channels such that the ratio of average currents between the fourth and fifth channel is 3:1.

Performing the brightness calculations in the processing device 210 as opposed to the luminance controller 310 is beneficial for reducing the size and complexity of the luminance controller 310. The circuitry for performing such duty cycle calculations can occupy a significant amount of space in an LED driver. However, in many systems that use LED drivers, such as televisions and monitors, a processing device 210 that is capable of performing such calculations is already an existing component of the system. These existing system resources can thus be leveraged to simplify the implementation of an adaptive switch LED driver. Further, unlike an LED driver 215, a processing device 210 may be programmable via firmware or otherwise, which allows for easy updating of the formulas for calculating brightness without any hardware changes.

In another embodiment, the processing device 210 calculates a duty cycle on time of the PWM switches $Q_P$ from $PWM_out_n$ with the following equation:

$$Ton_n = PWM_out_n \times Tperiod \tag{5}$$

where $Ton_n$ represents the duty cycle on-time for a switch $Q_P$ in channel n and Tperiod is the period of one complete duty cycle. Stated differently, $Ton_n$ and Tperiod are the representation of the duty cycle $PWM_out_n$ separated into two separate time components. $Ton_n$ and Tperiod can be measured in any unit of time, such as seconds or clock cycles. For example, if $PWM_out_n$ is 40% and Tperiod is 1000 clock cycles, $Ton_n$ is 400 clock cycles. In one embodiment, Tperiod can be determined by the processing device 210 in any of a number of ways, for example, from predetermined settings or from settings received from the video controller 205.

$Ton_n$ and Tperiod are communicated to the LED driver 215 as the duty cycle settings 394 for controlling the on and off times of the PWM switches $Q_P$. Communicating the duty cycle settings 394 to the LED driver in the form of $Ton_n$ and Tperiod, as opposed to $PWM_out_n$, is advantageous because it allows additional processing circuitry for converting $PWM_out_n$ into a $Ton_n$ time to be removed from the LED driver 215.

Luminous Transfer Function Compensation

Figure 4:
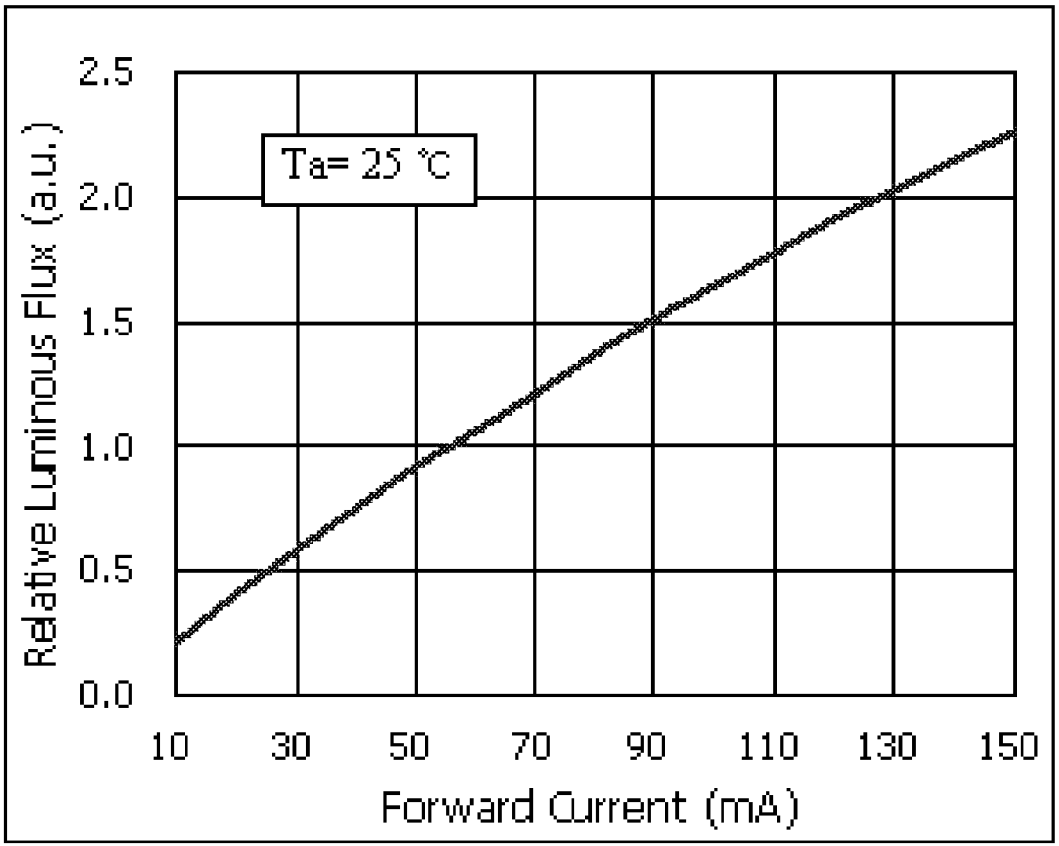
FIG. 4 is a plot illustrating a typical nonlinear transfer function between electrical current and optical luminance for a typical LED.

In an alternative embodiment, processing device 210 applies a modified version of equation (1) to account for non-linearity in the relationship between the luminous flux and the forward current of the LEDs. FIG. 4 is a plot of the relative luminous flux emitted from a forward conducting LED as a function of current. The plot illustrates that the optical efficiency drops as the forward current increases, and this causes a slight reduction in the slope. In one embodiment, processing device 210 models the luminance transfer function using a second ordered polynomial of the following form:

$$\mathrm{lum}(x)=c_2x^2+c_1x+c_0 \tag{6}$$

where the $c_0$, $c_1$, and $c_2$ are experimentally determined constants. In this embodiment, processing device 210 applies the following compensation equation to determine $\mathrm{PWM_out}_n$ for each LED channel n:

$$\mathrm{PWM_out}_n = BI_n\frac{lum(Iset)}{lum(I_n)} \tag{7}$$

In contrast to equation (1) above which matches the ratio of average currents between LED channel to the ratio of the brightness inputs $\mathrm{BI}_n$, equation (7) instead sets the relative luminous flux output of an LED channel proportionally to the relative brightness $\mathrm{BI}_n$. This provides for more precise maintenance of the relative brightness outputs between LED channels. Thus, LED channels configured with the same brightness inputs will have substantially the same brightness outputs.

In one embodiment, processing device 210 evaluates the ratio $$\frac{lum(Iset)}{lum(I_n)}$$

for each LED channel n during the calibration stage, and stores the results in memory. During real-time operation, processing device 210 only needs to perform the one remaining multiply operation of equation (7) whenever brightness input 382 is updated.

Temperature Compensation

Figure 5:
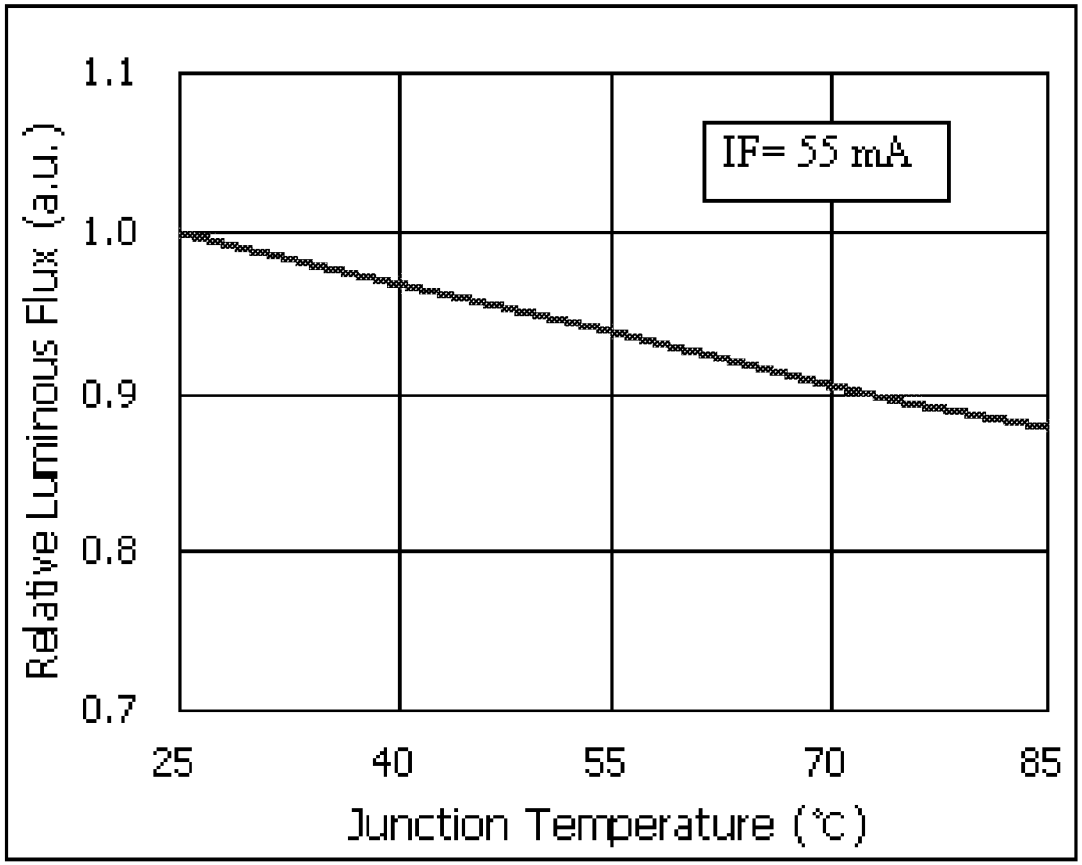
FIG. 5 is a plot illustrating a typical temperature de-rating of luminous flux density as a function of junction temperature for a typical LED.

In another alternative embodiment, processing device 210 applies a different modified version of equation (1) that additionally provides compensation for temperature variations between the LED channels. FIG. 5 is a plot of the relative luminous flux density emitted from a forward biased LED with 55 mA forward current as a function of junction temperature. The plot illustrates an approximately 12% reduction in luminance as the junction temperature of the LEDs is raised from 25 to 85 degrees centigrade. This reduction is a substantially linear function of temperature. Thus, in one embodiment processing device 210 applies the following equation to determine $\mathrm{PWM_out}_n$ for each LED channel n:

$$\mathrm{PWM_out}_n = BI_n\frac{lum(Iset)}{lum(I_n)C_T} \tag{8}$$

where $C_T$ is an experimentally determined linear function of temperature. In this embodiment, processing device 210 is modified to include an additional temperature input signal (not shown) configured to receive temperature data for the LED strings 225. The temperature data can be obtained using any conventional LED temperature measurement techniques.

System with Multiple LED Drivers

Figure 6A:
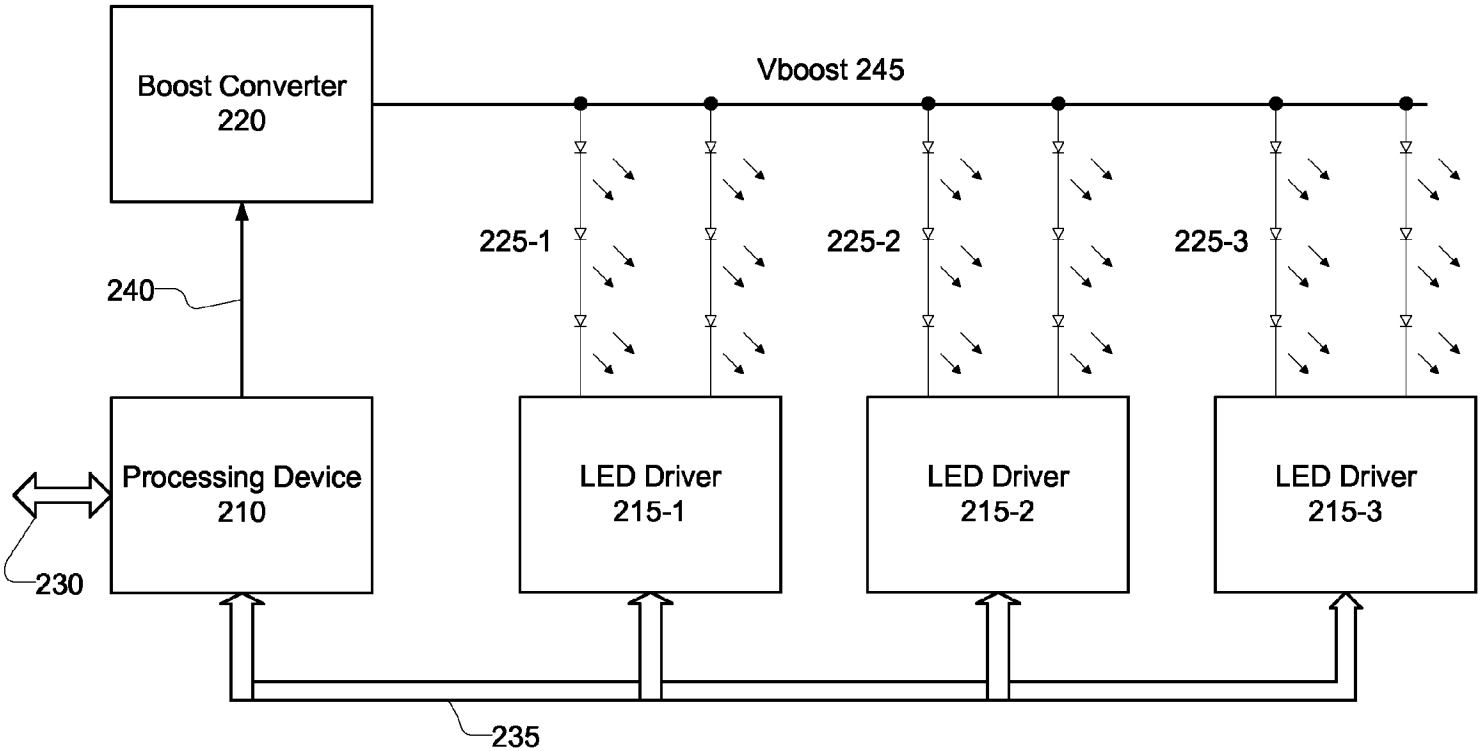
FIGS. 6A and 6B illustrate embodiments of a system with multiple LED drivers.
Figure 6B:
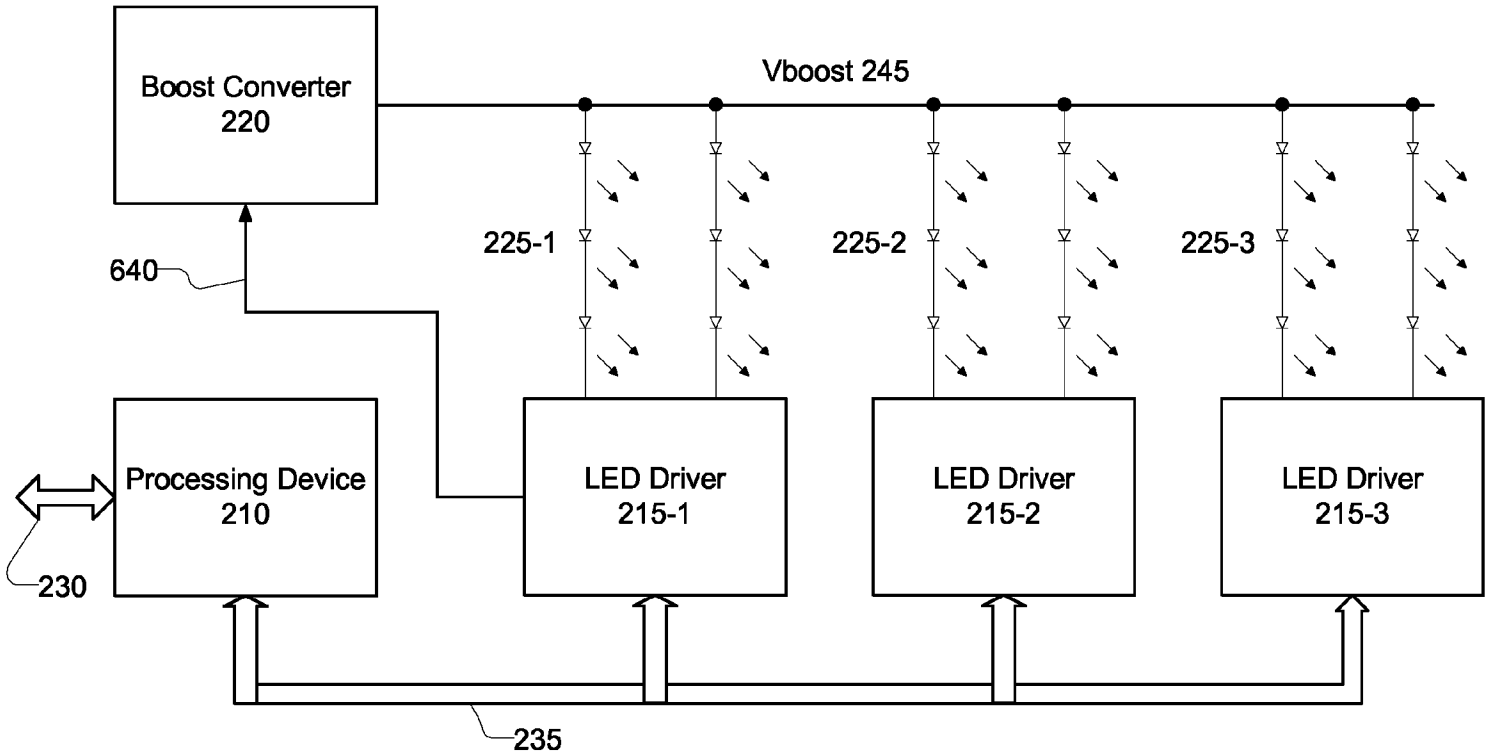

FIGS. 6A and 6B illustrate embodiments of a system with multiple LED drivers 215. FIG. 6A is similar to FIG. 2, except that the system now includes three LED drivers (e.g., 215-1, 215-2, 215-3) coupled to processing device 210 via communication link 235. In other embodiments, there may be fewer or more LED drivers 215. Each LED driver 215 controls the current through one or more LED strings (e.g., 225-1, 225-2, 225-3) based on programmed current levels and duty cycle settings received from the processing device 210. A boost converter 220 provides a common Vboost 315 voltage to all of the LED strings 225. The Vboost 245 voltage is controlled by the boost converter 220 based on a control signal 240 received from the processing device 210.

In one embodiment of FIG. 6A, the processing device 210 determines the proper Vboost voltage 245 during the calibration process that was previously described. In another embodiment, the LED drivers 215 and processing device 210 apply a modified calibration process to determine the proper voltage level of Vboost 245. During the calibration stage, each LED driver 215 attempts to set the Vboost 245 voltage so that its weakest LED string 225 operates at or near Iset. However, only the processing device 210 can directly control the boost converter 220 through control signal 240. Each LED driver 215 thus provides its own voltage settings to the processing device 210 via communication link 235. The processing device 210 selects the lowest voltage setting from the various voltage settings received from the different LED drivers 215. The processing device 210 sets the Vboost 245 voltage in accordance with the lowest voltage setting via control signal 240. In other embodiments, the lowest voltage setting may also be transmitted from the processing device 210 to all the LED drivers 215.

FIG. 6B is similar to FIG. 6A, except that the control signal 640 for controlling the boost converter 220 is now connected to LED driver 215-1 instead of the processing device 210. In this embodiment, the LED drivers 215 and processing device 210 apply a different modified calibration process to determine the proper voltage level of Vboost 245. During the calibration stage, each LED driver 215 attempts to set the Vboost 245 voltage so that its weakest LED string 225 operates at or near Iset. However, only one LED driver 215-1 is directly connected to the boost converter 220 for controlling the Vboost 245 voltage. Each LED driver (e.g., 215-1, 215-2, and 215-3) thus provides its own voltage settings to the processing device 210 via communication link 235. The processing device 210 selects the lowest voltage setting from the various voltage settings received from the different LED drivers 215 and transmits the lowest voltage setting to LED driver 215-1. LED driver 215-1 then sets the Vboost 245 voltage via control signal 640 in accordance with the voltage setting received from the processing device 210.

Method of Operation

Figure 7:
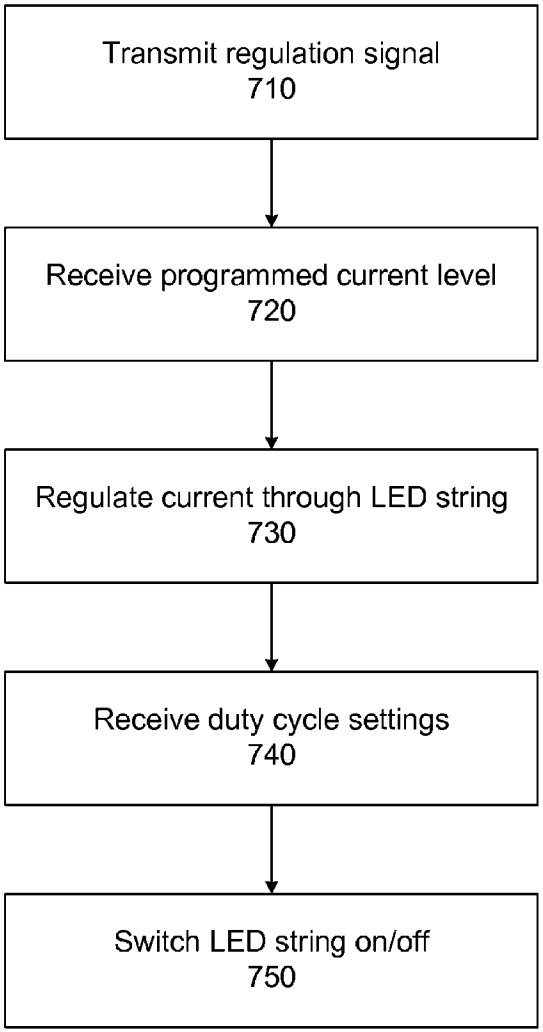
FIG. 7 illustrates an embodiment of a method performed by the LED driver for driving one or more LED strings.

FIG. 7 illustrates an embodiment of a method performed by the LED driver 215 for driving one or more LED strings 225. The LED driver transmits 710, to the processing device via a communication link, regulation information that indicates whether current in the LED string is out of regulation. Using the regulation information, the processing device sets a programmed current level during a calibration stage that keeps the LED string in regulation. The programmed current level is determined from a limited set of programmable current levels.

The LED driver receives 720 the programmed current level from the processing device via a communication link and regulates 730 current through the LED string according to the programmed current level. The LED driver also receives 740 duty cycle settings from the processing device for switching the first LED string on and off. The duty cycle is determined by the processing device as a function of the programmed current level. The LED driver then switches 750 the LED string on or off at the duty cycle indicated by the duty cycle settings. This process can be repeated for any of a number of LED strings so that each LED string is independently controlled.

Upon reading this disclosure, those of skill in the art will appreciate still additional alternative designs for the firmware controlled adaptive switch mode LED driver. Thus, while particular embodiments and applications of the present invention have been illustrated and described, it is to be understood that the invention is not limited to the precise construction and components disclosed herein and that various modifications, changes and variations which will be apparent to those skilled in the art may be made in the arrangement, operation and details of the method and apparatus of the present invention disclosed herein without departing from the spirit and scope of the invention as defined in the appended claims.

What is claimed is:

1. A system for driving one or more light-emitting diode (LED) strings, the system comprising:

a first LED driver device configured to regulate peak current through a first LED string according to a first programmed current level and to switch the first LED string on or off at a first duty cycle; and a processing device configured to determine the first duty cycle for the first LED string as a function of the first programmed current level, to transmit a first setting for the first duty cycle for the first LED string to the first LED driver device via a communication link, and to transmit a second setting for the first programmed current level for the first LED string to the first LED driver device via the communication link, the processing device being an integrated circuit that is distinct from the first LED driver device.

2. The system of claim 1, wherein the first LED driver device transmits regulation information indicating whether the current through the first LED string is out of regulation to the processing device via the communication link, and wherein the processing device determines the first programmed current level to keep the current through the first LED string in regulation based on the regulation information.

3. The system of claim 1, wherein the processing device is further configured to determine the first programmed current level for the first LED string to correspond to one of a limited set of programmable current levels.

4. The system of claim 1, wherein the processing device further determines the first duty cycle as a function of a baseline current level and a baseline duty cycle.

5. The system of claim 1, wherein the first LED driver device comprises:

a first channel regulator configured to regulate the current through the first LED string according to the first programmed current level; and a first channel switch configured to switch the first LED string on or off at the first duty cycle.

6. A system for driving one or more light-emitting diode (LED) strings, the system comprising:

a first LED driver device configured to regulate current through a first LED string according to a first programmed current level and to switch the first LED string on or off at a first duty cycle, the first LED driver device configured to regulate current through a second LED string according to a second programmed current level and to switch the second LED string on or off at a second duty cycle, the second LED string having different current-voltage characteristics than the first LED string and the second programmed current level being different than the first programmed current level; and a processing device configured to determine the first duty cycle for the first LED string as a function of the first programmed current level and to determine the second duty cycle for the second LED string as a function of the second programmed current level, the processing device being an integrated circuit that is distinct from the first LED driver device.

7. The system of claim 6, wherein the processing device determines the first duty cycle as a function of the first programmed current level based in part on a luminance transfer function such that luminous flux is substantially matched between the first and second LED strings configured for a same relative brightness.

8. The system of claim 7, wherein the processing device receives a temperature measurement, and wherein the luminance transfer function includes a temperature compensation function for compensating for temperature variations between the first and second LED strings.

9. A system for driving one or more light-emitting diode (LED) strings, the system comprising:

a first LED driver device regulating current through a first LED string according to a first programmed current level and switching the first LED string on or off at a first duty cycle;

a processing device determining the first duty cycle for the first LED string as a function of the first programmed current level, the processing device being an integrated circuit that is distinct from the first LED driver device;

a second LED driver device regulating current through a second LED string; and a power converter providing a common voltage to the first and second LED strings, wherein the first LED driver device transmits a first voltage setting to the processing device and the second LED driver device transmits a second voltage setting to the processing device, wherein the processing device selects a lowest of the first and second voltage settings for controlling the voltage provided by the power converter.

10. A light-emitting diode (LED) driver device for driving one or more LED strings, the LED driver device comprising:

a first channel regulator configured to regulate current through a first LED string according to a first programmed current level;

a first channel switch configured to switch the first LED string on or off at a first duty cycle; and a luminance control circuit configured to receive settings for the first duty cycle and the first programmed current level from the processing device via a communication link, wherein the first duty cycle is determined as a function of the first programmed current level by the processing device, the processing device being an integrated circuit that is distinct from the LED driver device.

11. The LED driver device of claim 10, wherein the luminance control circuit is configured to transmit regulation information indicating whether the first LED string is out of regulation to the processing device via the communication link, and wherein the first programmed current level is determined by the processing device to keep the current through the first LED string in regulation based on the regulation information.

12. The LED driver device of claim 10, wherein the first programmed level is determined by the processing device to correspond to one of a limited set of programmable current levels.

13. The LED driver device of claim 10, wherein the first duty cycle is further determined by the processing device as a function of a baseline current level and a baseline duty cycle.

14. A light-emitting diode (LED) driver device for driving one or more LED strings, the LED driver device comprising:

a first channel regulator configured to regulate current through a first LED string according to a first programmed current level;

a first channel switch configured to switch the first LED string on or off at a first duty cycle, the first duty cycle determined as a function of the first programmed current level by a processing device and the LED driver device receives settings for the first duty cycle from the processing device, the processing device being an integrated circuit that is distinct from the LED driver device;

a second channel regulator configured to regulate current through a second LED string according to a second programmed current level, the second programmed current level being different than the first programmed current level; and a second channel switch configured to switch the second LED string on or off at a second duty cycle, the second LED string having different current-voltage characteristics than the first LED string, and wherein the second duty cycle for the second LED string is determined by the processing device as a function of the second programmed current level.

15. The LED driver device of claim 14, wherein the first duty cycle is determined by the processing device as a function of the first programmed current level based in part on a luminance transfer function such that luminous flux is substantially matched between the first and second LED strings configured for a same relative brightness.

16. The LED driver device of claim 15, wherein the luminance transfer function includes a temperature compensation function for compensating for temperature variations between the first and second LED strings based on a temperature measurement received by the processing device.

17. A method for driving one or more light-emitting diode (LED) strings with a LED driver device, the method comprising:

receiving a first setting for a first duty cycle for a first LED string, the first setting received at the LED driver device from a processing device via a communication link, the processing device being an integrated circuit that is distinct from the LED driver device;

receiving a second setting for a first programmed current level for the first LED string, the second setting received at the LED driver device from the processing device via the communication link, the processing device determining the first duty cycle as a function of the first programmed current level;

regulating peak current through the first LED string according to the first programmed current level for the first LED string;

and switching the LED string on or off according to the first duty cycle for the first LED string.

18. The method of claim 17, further comprising transmitting regulation information indicating whether current in the first LED string is out of regulation to the processing device via the communication link, and wherein the first programmed current level is determined by the processing device to keep the current in the first LED string in regulation based on the regulation information.

19. The method of claim 17, wherein the first programmed current level is determined from a limited set of programmable current levels by the processing device.

20. The method of claim 17, wherein the first duty cycle is further determined by the processing device as a function of a baseline current level and a baseline duty cycle.

21. A method for driving one or more light emitting diode (LED) strings with a LED driver device, the method comprising:

regulating current through a first LED string according to a first programmed current level;

receiving settings for a first duty cycle for switching the first LED string, the first duty cycle determined as a function of the first programmed current level by a processing device, the processing device being an integrated circuit that is distinct from the LED driver device;

switching the LED string on or off according to the first duty cycle;

regulating current through a second LED string according to a second programmed current level, the second programmed current level being different than the first programmed current level;

receiving settings for a second duty cycle for switching the second LED string, the duty cycle determined as a function of the second programmed current level and received from the processing device; and switching the second LED string on or off at the second duty cycle.

22. The method of claim 21, wherein the first duty cycle is determined by the processing device as a function of the first programmed current level based in part on a luminance transfer function such that luminous flux is substantially matched between the first and second LED strings configured for a same relative brightness.

23. The method of claim 22, wherein the luminance transfer function includes a temperature compensation function for compensating for temperature variations between the first and second LED strings based on a temperature measurement received by the processing device.

* * * * *